US007842003B2

(12) United States Patent
Jones et al.

(10) Patent No.: US 7,842,003 B2
(45) Date of Patent: Nov. 30, 2010

(54) PULSATILE FLUID DELIVERY SYSTEM

(75) Inventors: Kenneth A. Jones, McKinney, TX (US); Cristo Suresh Corera, McKinney, TX (US); Richard S. Hayes, McKinney, TX (US)

(73) Assignee: Quest Medical, Inc., Allen, TX (US)

( * ) Notice: Subject to any disclaimer, the term of this patent is extended or adjusted under 35 U.S.C. 154(b) by 417 days.

(21) Appl. No.: 11/297,989

(22) Filed: Dec. 9, 2005

(65) Prior Publication Data

US 2007/0134101 A1 Jun. 14, 2007

(51) Int. Cl.
*A61M 37/00* (2006.01)
*F04B 43/12* (2006.01)
*A61N 1/362* (2006.01)

(52) U.S. Cl. ..... 604/6.11; 604/4.01; 417/477.1; 600/16; 600/17

(58) Field of Classification Search ..... 604/65–67, 604/6.11, 6.13; 600/16, 17; 623/3.1, 3.11, 623/3.16, 3.17; 422/44; 417/412, 426, 321, 417/375, 477.1, 477.2
See application file for complete search history.

(56) References Cited

U.S. PATENT DOCUMENTS

| | | | | |
|---|---|---|---|---|
| 2,018,998 | A | 10/1935 | DeBakey | |
| 3,597,766 | A * | 8/1971 | Buck | 623/3.22 |
| 4,116,589 | A | 9/1978 | Rishton | |
| 4,376,312 | A * | 3/1983 | Robinson et al. | 623/3.21 |
| 5,300,015 | A | 4/1994 | Runge | |
| 5,520,652 | A | 5/1996 | Peterson | |
| 5,573,502 | A | 11/1996 | LeCocq et al. | |
| 5,638,737 | A * | 6/1997 | Mattson et al. | 92/101 |
| 5,645,531 | A * | 7/1997 | Thompson et al. | 604/67 |
| 5,702,358 | A | 12/1997 | Witherspoon et al. | |
| 5,941,891 | A | 8/1999 | Walen | |
| RE36,386 | E | 11/1999 | Abbott et al. | |
| 6,083,198 | A | 7/2000 | Afzal | |
| 6,174,144 | B1 | 1/2001 | van Hamme et al. | |
| 6,422,990 | B1 * | 7/2002 | Prem | 600/17 |
| 6,620,121 | B1 | 9/2003 | McCotter | |
| 2003/0088238 | A1 | 5/2003 | Poulsen et al. | |
| 2004/0015042 | A1 * | 1/2004 | Vincent et al. | 600/17 |

* cited by examiner

*Primary Examiner*—Leslie R Deak
(74) *Attorney, Agent, or Firm*—David W. Carstens; Carstens & Cahoon, LLP

(57) ABSTRACT

A system for delivering blood, cardioplegia solution, and other medications or fluids in a pulsatile flow pattern to a patient during cardiopulmonary bypass is disclosed. In a preferred embodiment, a pumping apparatus having at least one chamber is utilized in which a pumping action is achieved by compressing one of the chambers with a piston mechanism, while allowing the other chamber to fill with fluid via retracting its respective piston. The instantaneous flow rate of either of the chambers is determined by the speed of the piston. In a preferred embodiment, a pulsatile flow of fluid is achieved by cyclically alternating the velocity of the piston between two different speeds. A desired average flow rate and/or delivery pressure and/or constant pulse pressure is maintained by adjusting the alternating velocities at the desired frequency and duty cycle. The calculations necessary to obtain a desired average flow rate are performed by a microprocessor, which also controls the movement of the pistons.

38 Claims, 11 Drawing Sheets

PULSATILE FLUID DELIVERY SYSTEM

CROSS-REFERENCE TO RELATED PATENTS

The present application is related to the following commonly-assigned, issued U.S. patents, which are incorporated herein by reference in their entirety: U.S. Pat. No. RE36,386 (ABBOTT et al.) Nov. 9, 1999, U.S. Pat. No. 5,573,502 (LECOCQ et al.) Nov. 12, 1996, U.S. Pat. No. 5,638,737 (MATTSON et al.) Jun. 17, 1997, and U.S. Pat. No. 5,645,531 (THOMPSON et al.) Jul. 8, 1997.

BACKGROUND OF THE INVENTION

1. Technical Field

The present invention relates generally to equipment used to deliver fluids to a patient during surgery. Specifically, the present invention is directed to a device for delivering cardioplegia solution during open-heart surgery and other surgical procedures requiring myocardial protection.

2. Background Art

Heart surgery is among the most complex of surgical fields. Because under normal conditions, the heart muscle is in a constant state of motion, special techniques must be used to make the heart sufficiently stationary to allow a surgeon to operate on it. Although some surgical procedures may be performed on a beating heart, the majority of open-heart and closed-heart procedures, including coronary artery bypass surgery, require that the heart be slowed or stopped and the aorta clamped before the cardiac portion of the surgery may begin. In such procedures, external equipment is used to form an extracorporeal circuit in the patient's circulatory system. Electric/mechanical pumps are used to pump the blood to an artificial oxygenator, then back into the patient, so as to temporarily replace the patient's heart and lungs during the procedure. This technique is known as a "cardiopulmonary bypass," and it allows the surgical team to stop the heart, while still keeping the patient alive.

The heart muscle (myocardium), no less than any other organ of the body, must also be kept alive during the procedure. Indeed, the myocardium has a very low tolerance for ischemia (reduction in blood supply), due to its high oxygen requirements. Thus, special techniques are employed to protect the myocardium during a cardiopulmonary bypass.

Modern surgical teams often use induced cardioplegia to both stop the heart and protect it from the effects of ischemia. A potassium-based cardioplegic solution is infused into the coronary arteries, usually at a low temperature. The potassium infusion causes an immediate cardiac arrest, while the typically low temperature of the solution reduces the heart's rate of oxygen consumption. There are two commonly-employed cardioplegic methods, blood cardioplegia and crystalloid cardioplegia. Blood cardioplegia is a solution that is mixed with oxygenated blood from the extracorporeal circuit. Crystalloid cardioplegic solution is a non-cellular solution with a saline or balanced electrolyte base such as Ringer's solution. Nowadays, cardioplegia may bedelivered through antegrade (that is, directly through the coronary arteries) or retrograde (through the coronary sinus vein) routes.

During cardiopulmonary bypass, both blood and cardioplegia solution must be circulated through the patient's body. Since the heart is no longer available to maintain the patient's circulation, artificial pump means must be employed. The most commonly employed pump is the DeBakey roller pump, which is described in U.S. Pat. No. 2,018,998 (DEBAKEY et al.) Oct. 29, 1935. The DeBakey pump uses a pair of rollers to create a peristaltic action against a flexible tube. Centrifugal pumps are also employed. Both of these types of pumps produce a relatively constant rate of flow.

Recent research, however, suggests that better cardiac perfusion is obtained with a pulsatile flow than with a constant-rate flow. The heart, after all, is a reciprocating pump and delivers a pulsatile flow. A number of designs have been developed to introduce a pulsatile component to extracorporeal circulation. These designs generally fall into two categories. A first category consists of those devices that combine a roller or centrifugal pump with an additional device that periodically compresses the tube through which the blood or cardioplegia flows. Examples of these devices include U.S. Pat. No. 4,116,589 (RISHTON) Sep. 26, 1978, and U.S. Pat. No. 6,620,121 (MCCOTTER) Sep. 16, 2003.

A second category consists of devices in which the pump itself is used to produce a pulsatile flow. In one type of pump, such as that in U.S. Pat. No. 5,702,358, the number of revolutions per minute (RPM) of a centrifugal pump is varied in a periodic fashion to achieve a roughly pulsatile flow. In U.S. Pat. No. 5,300,015 (RUNGE) Apr. 5, 1994, a type of peristaltic pump is described, which achieves a pulsatile flow. Both of these types of designs, however, are limited in their ability to produce a pulsatile flow of desired characteristics while still maintaining a desired average flow rate.

What is needed, therefore, is an apparatus for extracorporeal circulation that produces a significantly pulsatile flow, while still-maintaining a user-specified average flow rate. The present invention provides a solution to this and other problems, and offers other advantages over previous solutions.

SUMMARY OF THE INVENTION

A preferred embodiment of the present invention provides a system for delivering blood, cardioplegia solution, and other medications or fluids in a pulsatile flow to a patient during cardiopulmonary bypass. In one embodiment, a dual chambered pumping apparatus is utilized in which a pumping action is achieved by compressing one of the chambers with a piston mechanism, while allowing the other chamber to fill with fluid by retracting its respective piston. The instantaneous flow rate of either of the chambers is determined by the speed of the piston. In another embodiment, a single chambered pumping apparatus is used. In this embodiment, the piston can be delivering fluid during a stroke while at the same time filling the chamber on the opposite side of the piston. In a preferred embodiment, a pulsatile flow of fluid is achieved by cyclically alternating the velocity of the piston between two different speeds. A desired average flow rate is maintained by adjusting the alternating velocities and a duty cycle for the flow rate alternation. The calculations necessary to obtain a desired average flow rate are performed by a microprocessor, which also controls the movement of the pistons.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings, wherein.

DETAILED DESCRIPTION

The following is intended to provide a detailed description of an example of the invention and should not be taken to be limiting of the invention itself. Rather, any number of variations may fall within the scope of the invention, which is defined in the claims following the description.

A preferred embodiment of the present invention is directed to a system for delivering a pulsatile flow of blood and crystalloid cardioplegia solution to a patient undergoing open-heart surgery. In particular, a preferred embodiment of the present invention allows a perfusionist or surgeon to select between two different delivery modes, one in which fluids are delivered to the patient in a pulsatile flow and another in which fluids are delivered to the patient in a nonpulsatile flow. The two different modes of operation are supported by software, which controls the mechanical operation of the pump. The electromechanical components utilized in both modes are the same, the only difference between the two modes being the software processes used to control the electromechanical components of the system.

Figure 12:
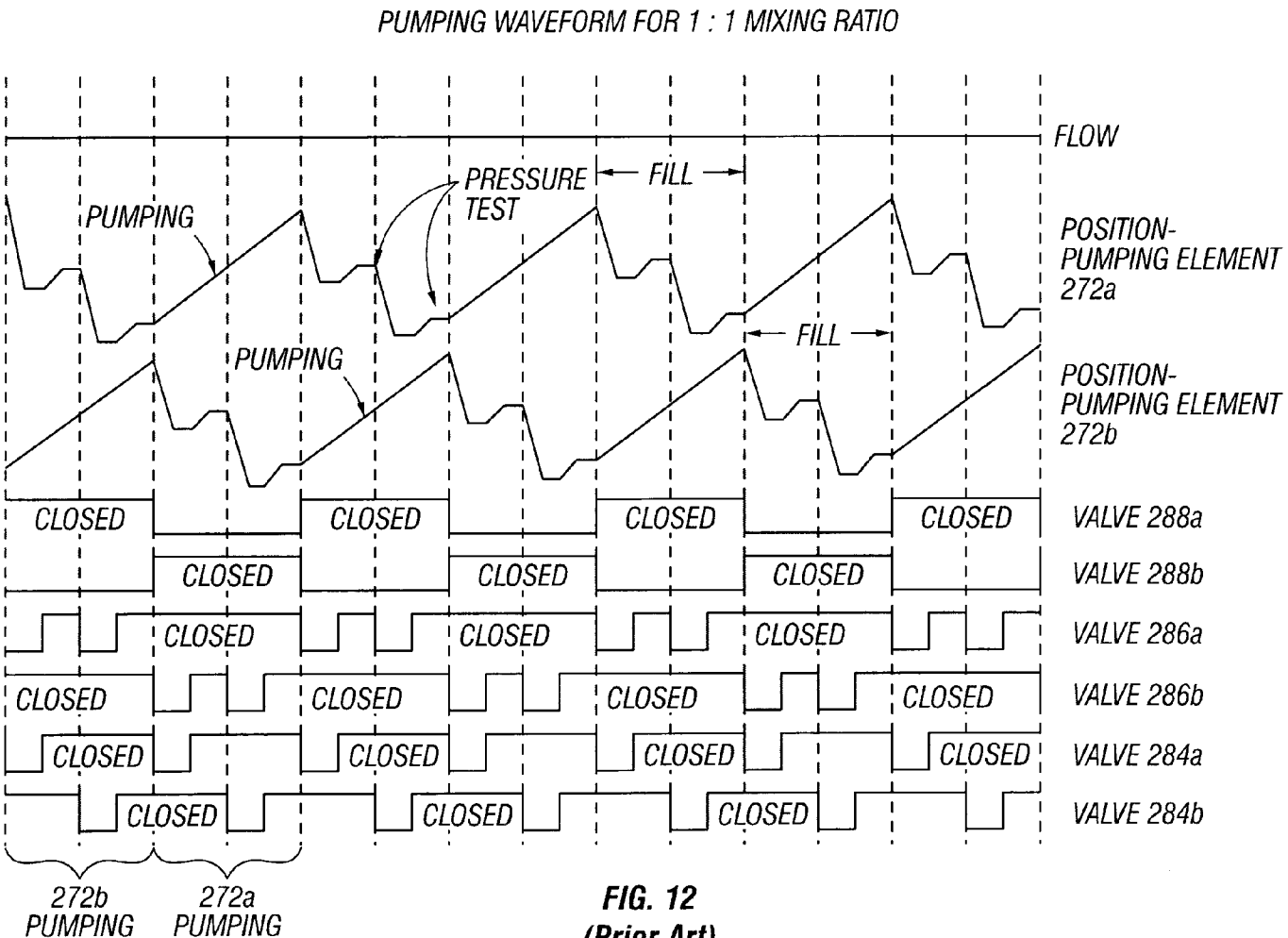
FIG. 12 (Prior Art)
FIG. 12 is a timing diagram illustrating a cycle of the blood/crystalloid pump depicted in FIGS. 1-11 when operated in a non-pulsatile flow mode.
Figure 13:
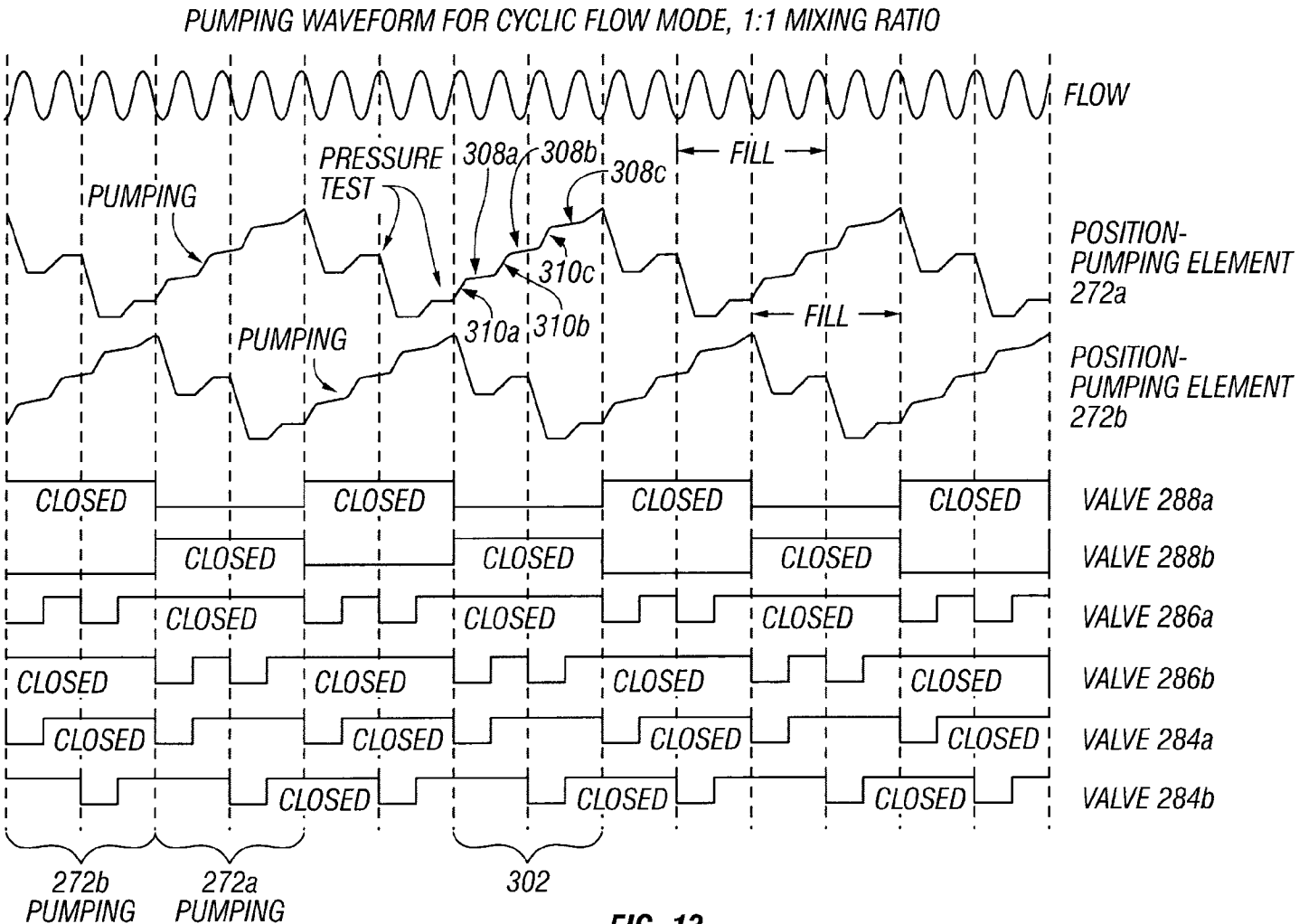
FIG. 13 is a timing diagram illustrating a cycle of the blood/crystalloid pump depicted in FIGS. 1-11 when operated in a pulsatile flow mode in accordance with a preferred embodiment of the present invention.
Figure 14:
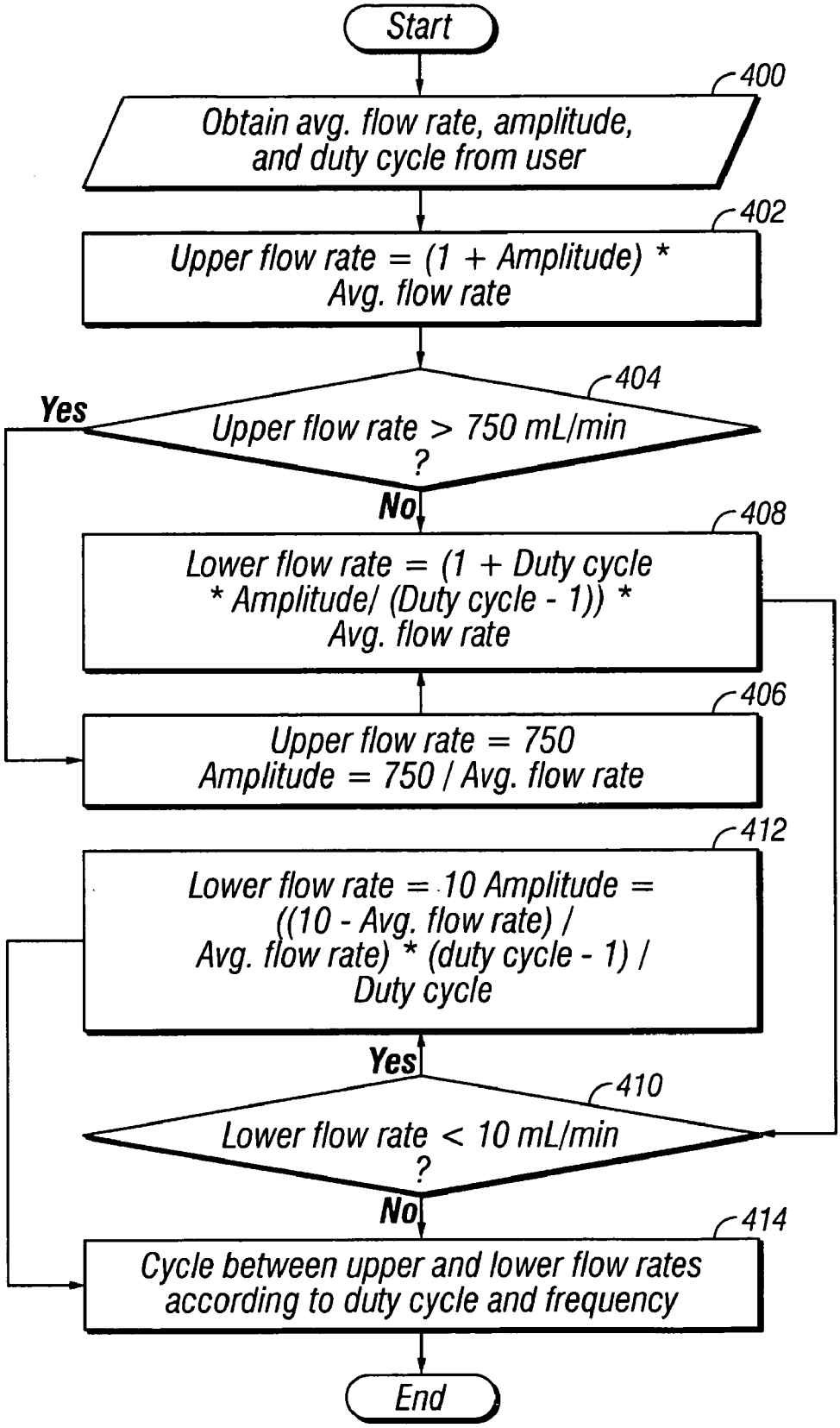
FIG. 14 is a flowchart representation of a method of producing a pulsatile flow in accordance with a preferred embodiment of the present invention.

FIGS. 1-11, therefore, describe the electromechanical aspects of the invention, which are common to both modes. FIG. 12, on the other hand, describes the operation of the nonpulsatile flow mode. FIGS. 13 and 14 describe the operation of the pulsatile flow mode.

Figure 1:
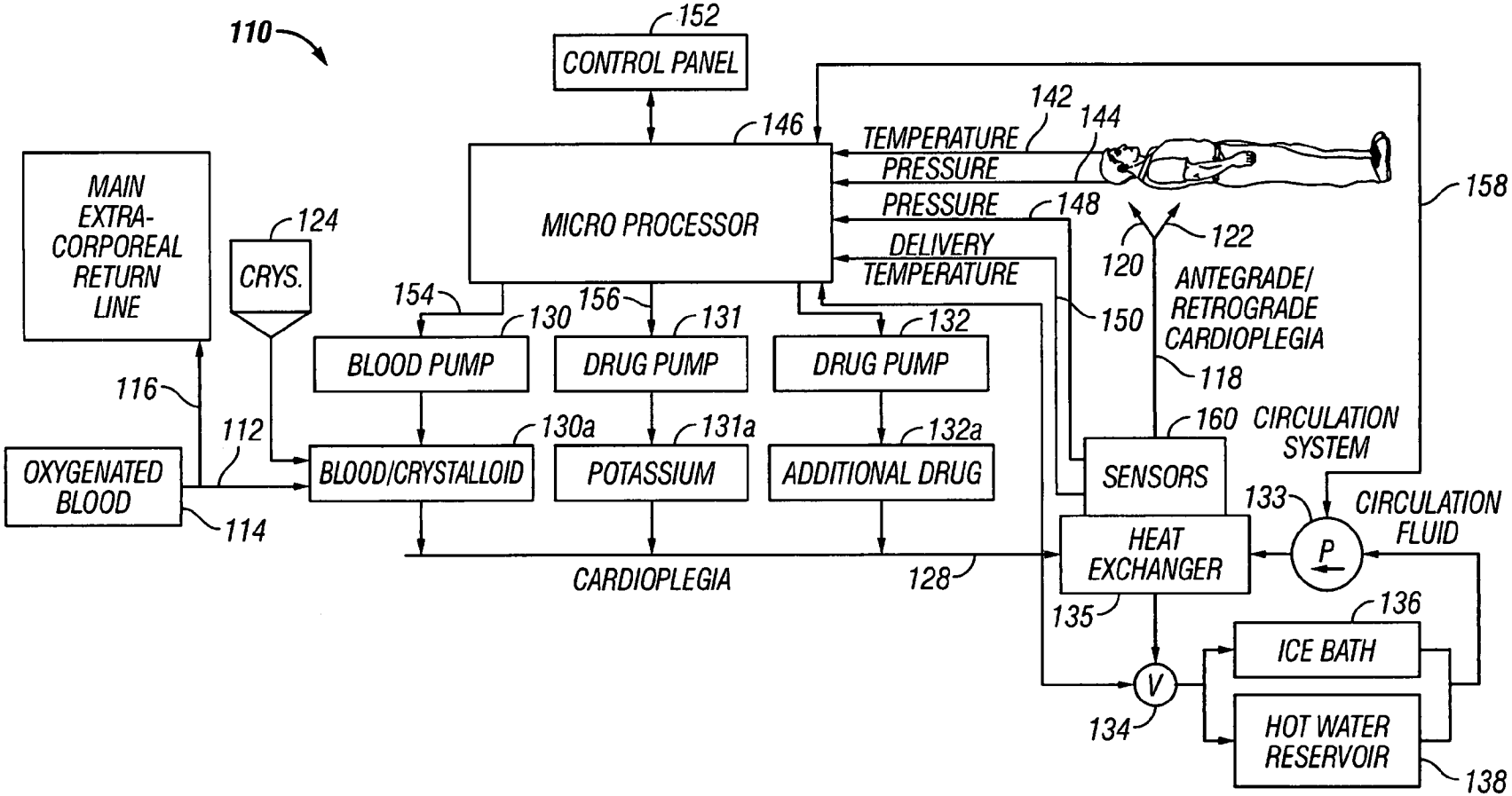
FIG. 1 is a schematic diagram of a cardioplegic delivery system embodying a preferred embodiment of the present invention.

Turning now to FIG. 1, a cardioplegia delivery system 110 is established to provide solution to the heart of a patient during open heart surgery. The principal component of the cardioplegic solution is blood delivered to the system through conduit 112, which is connected to the output of oxygenator 114 of the heart/lung machine sustaining the patient's vascular system while the heart is isolated during surgery. Oxygenator 114 provides arterial blood in the main extracorporeal circuit through a return line 116 to the patient's aorta. A fraction of the heart/lung machine output is diverted into conduit 112 for processing by the cardioplegic circuit and forwarding to the patient's heart through cardioplegia delivery line 118. The cardioplegic solution flowing through line 118 may be delivered through antegrade line 120 to the aortic root, or through retrograde line 122 to the coronary sinus.

A crystalloid solution is stored in container 124 for combination with blood flowing in line 112 in a disposable pumping cassette 130*a*. The output of cassette 130*a* is supplied through line 128 to a heat exchanger 135. Pump cassette 130*a* is controlled by an electromechanical pump mechanism 130 in which cassette 130*a* is mounted. A second pump 131 controls cassette 131*a* containing potassium solution supplies its output to line 128 downstream from the pump cassette 131*a*. A third pump 132 controls cassette 132*a* containing any additional drug supplies its output to line 128 downstream from the pump cassette 132*a*.

In heat exchanger 135, the cardioplegic solution is juxtaposed with a circulating temperature controlled fluid to adjust the temperature of the solution prior to forwarding the solution to the heart through line 118. Preferably pump 133 circulates temperature controlled fluid through heat exchanger 135 either by push or pull. FIG. 1 depicts a push-through coolant system in which a pump 133 circulates the control fluid through heat exchanger 135 and then to a two-way valve 134, which valve 134 may direct the circulating fluid either to an ice bath 136 for cooling or a heated water reservoir 138 for heating. The circulating fluid is then pumped back through heat exchanger 135, where the cardioplegia solution receives heating or cooling without contamination across a sealed heat transfer material or membrane within heat exchanger 135.

The system includes patient monitoring of myocardial temperature along the signal path 142 and heart pressure along signal path 144 communicating to a central microprocessor control section 146. In addition, the pressure and temperature of the cardioplegic solution in delivery line 118 is sensed via sensors 160 and the data is forwarded along signal paths 148 and 150 to control microprocessor 146. Data input to microprocessor 146 through control panel 152 may include an advantageous combination of the following parameters: desired overall volumetric flow rate, desired blood/crystalloid ratio to be forwarded, desired potassium concentration to be established by pump 131, desired supplemental drug concentration to be established by pump 132, desired temperature of solution in cardioplegia delivery line 118, and safety parameters such as the pressure of the cardioplegia solution in the system or in the patient.

In response to the data input through the control panel 152 and the monitored conditions along signal paths 142, 144, 148 and 150, microprocessor control section 146 controls the operation of pump mechanism 130, via signal path 154, and of potassium pump 131 by way of a signal along path 156. In addition, microprocessor control section 146 controls the circulation of fluid in the heat exchanger circulation path along signal path 158 either for obtaining a desired patient temperature or a desired output solution temperature. Further, the safety parameters such as pressure limits for a particular procedure or a particular patient may be controlled based upon input settings or based upon preset standards, as for example, one range of acceptable pressure limits for antegrade and another range for retrograde cardioplegia.

In accordance with a preferred embodiment of the invention, microprocessor controller section 146 controls the pump mechanism 130 to combine crystalloid from container 124 and blood from line 112 in any selected ratio over a broad range of blood/crystalloid ratios. Controller 146 may command the pump mechanism 130 to deliver blood without crystalloid addition. The blood/crystalloid ratio can be adjusted from an all blood mixture to an all crystalloid mixture, with multiple ratios in between. The rate of flow produced by the pump mechanism 130 of the combined output from disposable pump cassette 126 is preferably variable from 0 to 999 milliliters per minute. Potassium pump 131 is automatically controlled to maintain a constant potassium solution concentration. In other words, if the blood pump flow rate is increased, the potassium pump flow rate is automatically increased.

Figure 2:
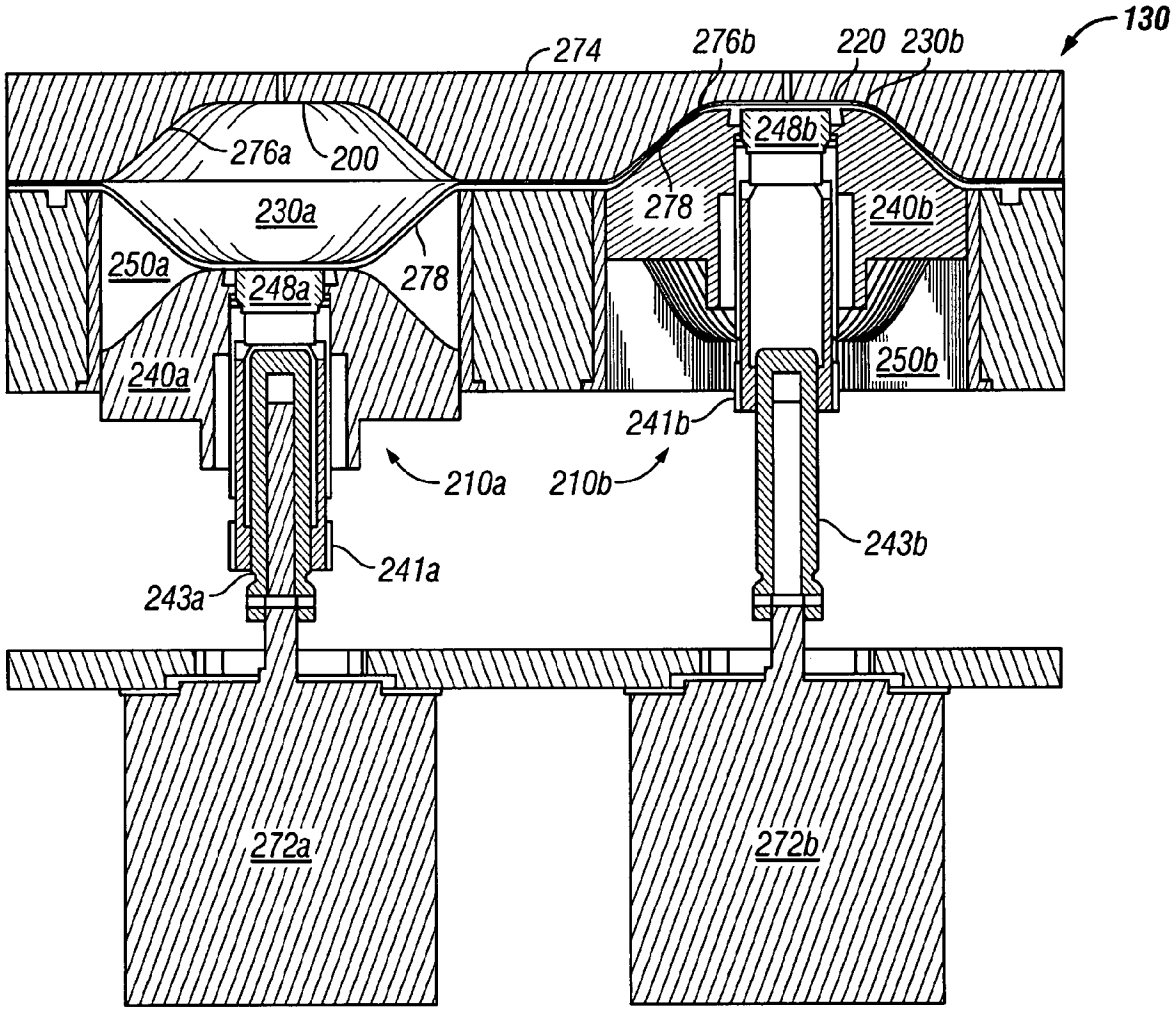
FIG. 2 is a schematic illustration of the functioning of one embodiment of a pump mechanism for use in a preferred embodiment of the present invention.

FIG. 2 illustrates one embodiment of a pump mechanism 130 for incorporation into a fluid delivery system such as that described in FIG. 1. The pump mechanism 130 operates on a flexible, disposable fluid cassette 220 which maintains the sterility of the fluid as it passes through the mechanism. The pump mechanism 130, as described herein, features two piston assemblies 210*a*, 210*b*. The piston assembly 210 of the present invention enables the mixing of multiple fluids in consistent, accurate ratios, and the delivery of such mixture at a definable, consistent volumetric flow rate. A fluid delivery system incorporating the present invention may have multiple applications within the medical industry and, in particular, applications in at least the areas of intravenous fluid delivery, limb perfusion, organ perfusion and cardioplegia delivery. Notwithstanding the foregoing, the present invention is adaptable to be incorporated into any variety of fluid delivery systems, whether medical related or not, and scalable to provide a large range of volumetric flow rates.

Figure 3:
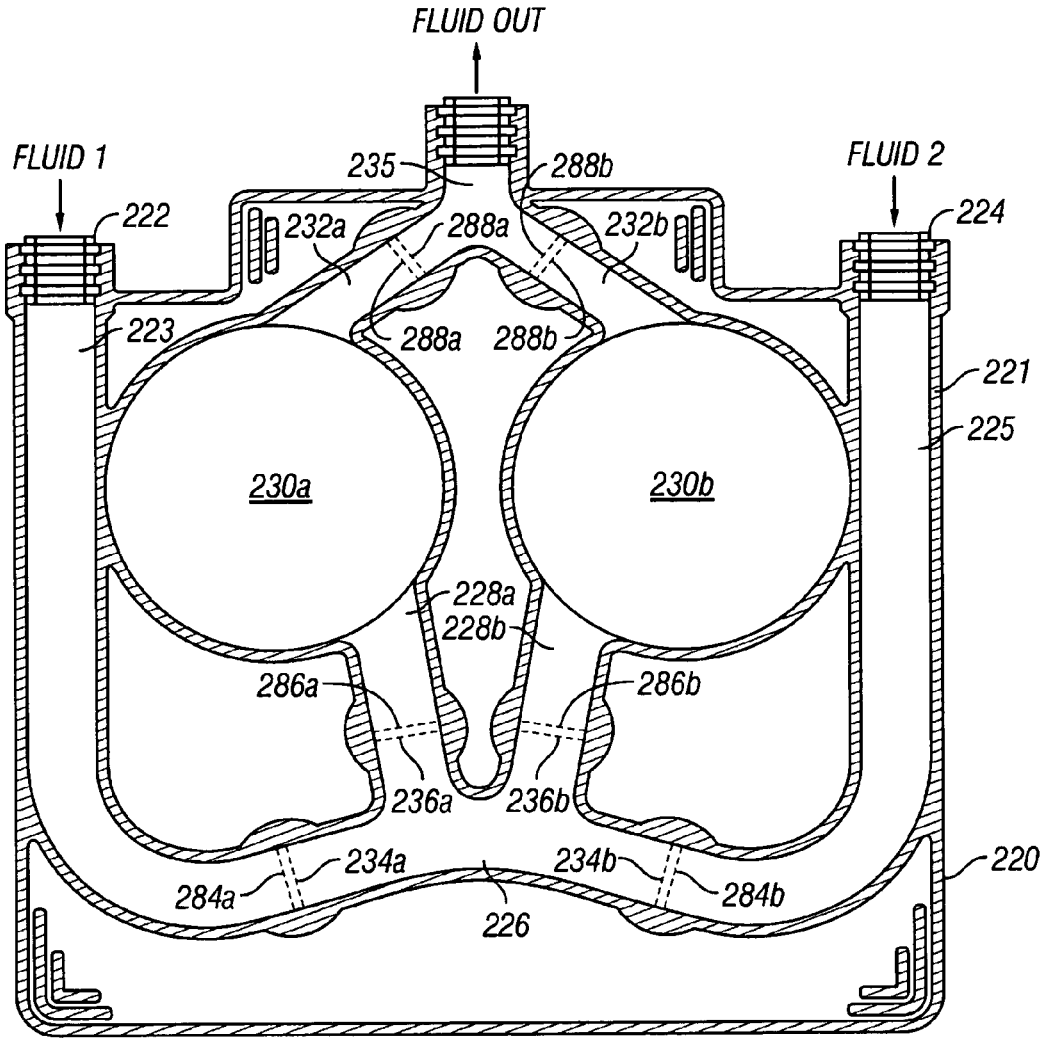
FIG. 3 is a plan view of one embodiment of a disposable fluid cassette for the pump mechanism of FIG. 2.

FIG. 3 illustrates one embodiment of a disposable fluid cassette 220. The cassette 220 may be formed from two thin, flexible sheets of material, such as polyvinylchloride. The sheets are bonded together along a selected bond area 221 to form particularized open flow paths and chambers. Any number of techniques (as an example, RF welding) may be employed for such bonding. The thickness of the material should be such that variations which occur during manufacture should not significantly affect the volumetric accuracy of the fluid output of pump mechanism 130.

The cassette 220 includes a first fluid inlet 222 and a second fluid inlet 224. In a preferred embodiment, the first fluid inlet 222 accommodates blood and the second fluid inlet accommodates a crystalloid fluid typically used during open heart surgery. Fluid entry paths 223, 225 run respectively from inlets 222, 224 to a common inlet path 226, which bifurcates to form inlet flow paths 228*a* and 228*b*. Inlet flow paths 228*a* and 228*b* respectively terminate in pump chambers 230*a*, 230*b*.

Outlet paths 232*a*, 232*b*, forming the respective output pathways from pump chambers 230*a*, 230*b*, join at a common outlet path 235. The outlet path 235 is the gateway for passage of the first and second fluid mixture to other portions of the fluid delivery system.

Figure 4:
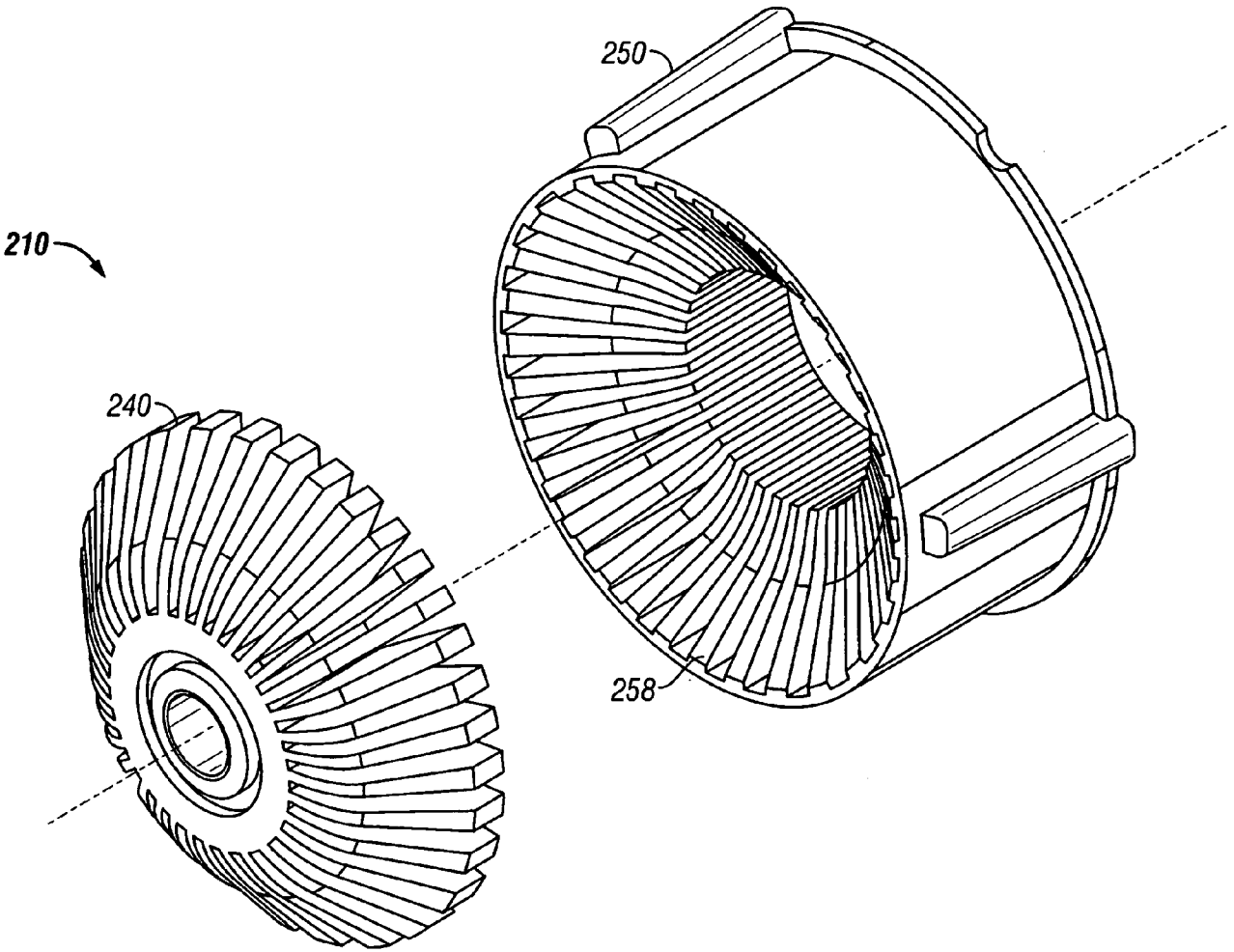
FIG. 4 is an exploded, perspective view of a piston assembly in accordance with a preferred embodiment of the present invention.

FIG. 4 illustrates the piston assembly 210 of FIG. 2. The piston assembly 210 has a piston 240 and a base 250, such base 250 being dimensioned to operatively receiving the piston 240. From FIGS. 5 and 6, piston 240 includes a central hub 242 with a plurality of splines 244 extending outwardly therefrom. The plurality of splines 244 are integrally formed with the hub 242 and extend radially outward. The piston 240 generally forms a convex supporting surface 247, wherein each spline 244 progresses from a full height at the hub 242 to a substantially lesser height at the perimeter of the piston 240. For the preferred embodiment, the angular displacement of the supporting surface 247 corresponds, although in a differing direction of displacement, to an angular displacement of a facial surface, or receiving surface 258, of the base 250.

Figure 5:
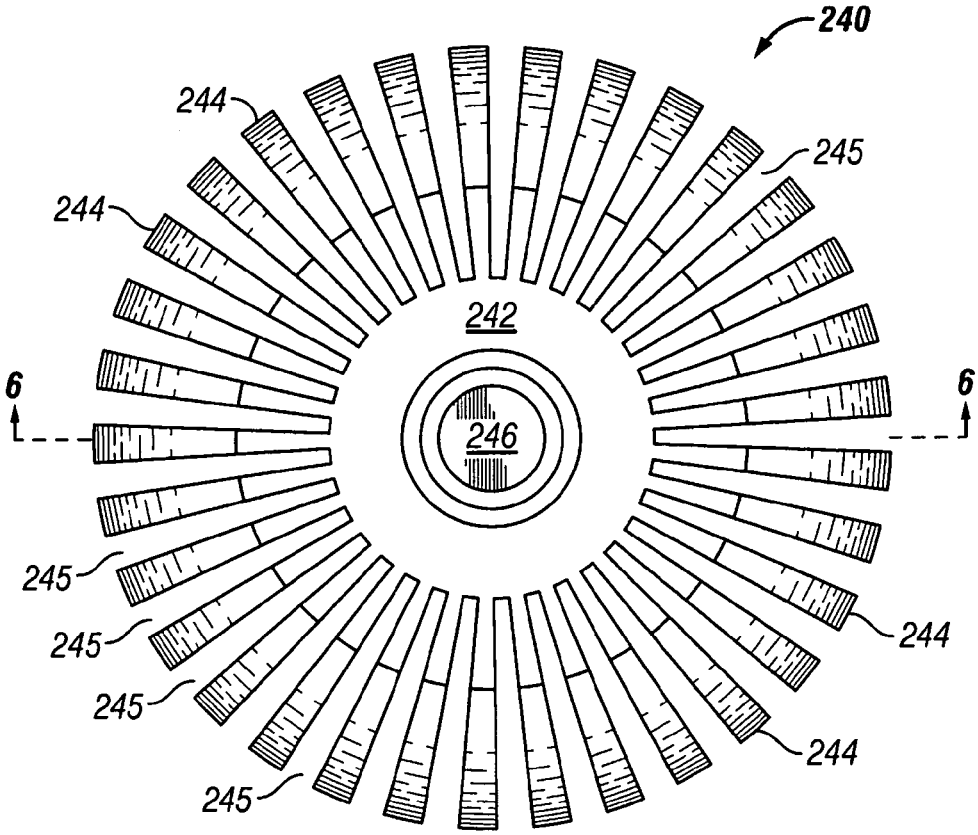
FIG. 5 is a plan view of the piston of the piston assembly of FIG. 4.
Figure 6:
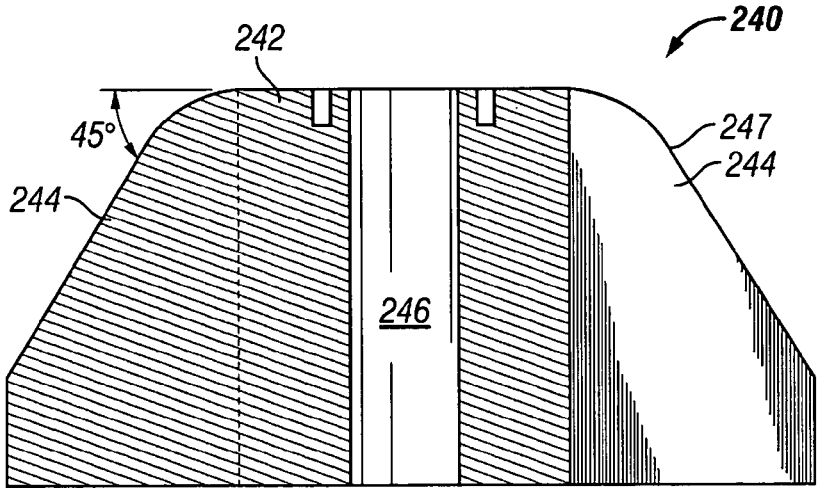
FIG. 6 is a sectional view of the piston along line 6-6 of FIG. 5.

As shown in FIG. 5, the hub 242 can include a passage 246 extending through the piston 240, such passage 246 extending along an axial centerline of the piston 240. In the preferred embodiment, the passage 246 receives and carries a contact pressure sensor 248 (see FIGS. 10 and 11). The incorporation of a pressure sensor 248 in the piston 240 permits monitoring of a fluid pressure within a pumping chamber associated with piston 240. Consequently, the intrachamber fluid pressure is useful in determining: (i) the volumetric content of pumping chamber 230, (ii) the presence of non-occluding valves adjacent pump chamber 230 and (iii) the presence of excessive fluid delivery pressures as well as excessive back-pressures presented to pump mechanism 130.

Figure 7:
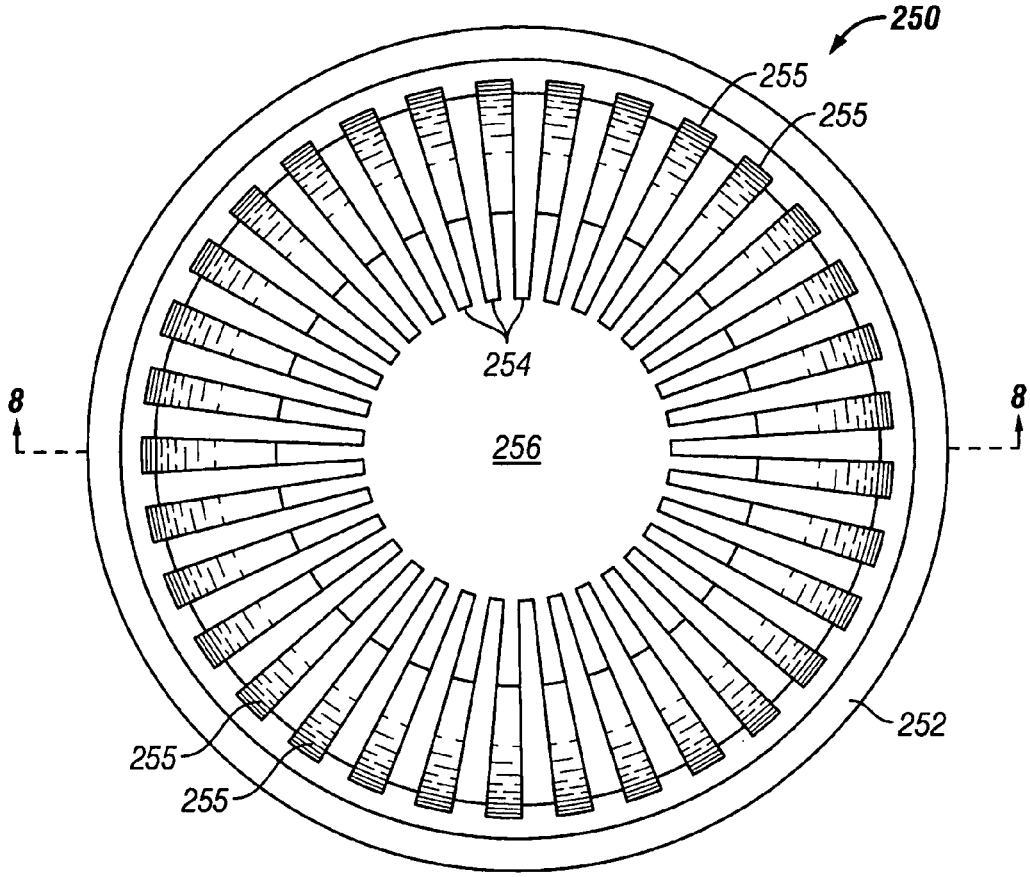
FIG. 7 is a plan view of the base of the piston assembly of FIG. 4.
Figure 8:
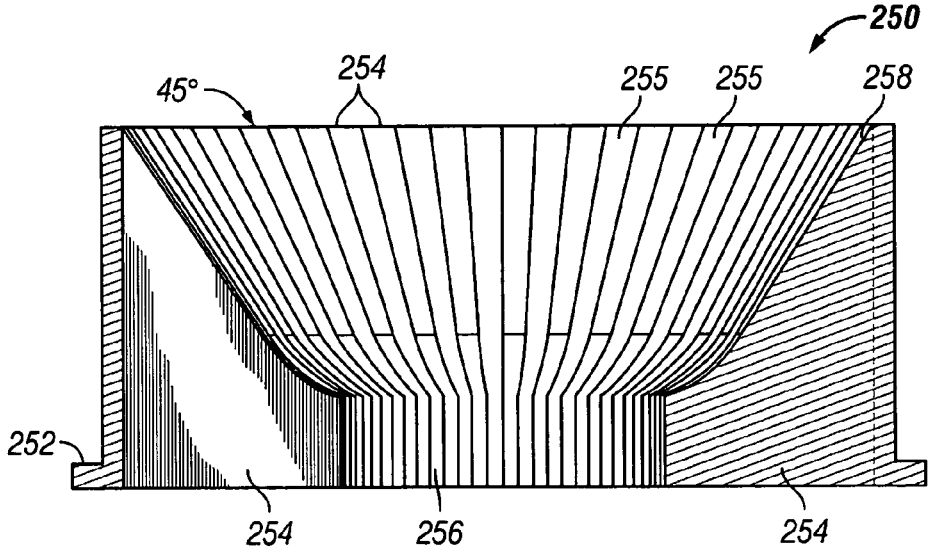
FIG. 8 is a sectional view of the base along line 8-8 of FIG. 7.

As shown in FIGS. 7 and 8, the base 250 includes a collar 252 and a plurality of ribs 254. The plurality of ribs 254 are integrally formed with collar 252 and extend radially inward to define a central passageway 256. The base 250 is constructed so as to (i) permit the hub 242 to be movably received by the central passageway 256 and (ii) allow the plurality of splines 244 to be movably interposed between the plurality of ribs 254 (see FIGS. 10 and 11). As shown in FIG. 8, the ribs 254 generally form a concave receiving surface 258 which inversely complements the convex supporting surface 247 of the piston 240. Accordingly, each rib 254 progresses from a full height at the collar 252 to a substantially lesser height at the perimeter of central passageway 256. In the preferred embodiment, the angular displacement of the receiving surface 258 is substantially 45 degrees. Further, the angular displacement of the supporting surface 247 of the piston 240 is substantially equivalent.

In the preferred embodiment, each spline 244 has a thickness substantially equal to that of each rib 254. Therefore, when the base 250 receives the piston 240 there exists limited and tightly controlled clearance between any rib-spline interface, thereby preventing the opportunity for the cassette material to become pinched or positioned between the elements during operation. The piston 240 may be manufactured from a lubricated material such as acetyl fluoropolymer (for example, Delrin AF from DuPont, Co., Wilmington, Del.), and the base 250 from a glass reinforced polycarbonate (for example, a 10% glass material Lexan 500 from GE Plastics, Pittsfield, Mass.), to permit largely unrestricted motion of the piston 240 relative to the base 250 despite the potential for repeated contact between two elements. The number of splines 244 and ribs 254 should be such that the space 245 between each spline 244 and the space 255 between each rib 254 (such being substantially equivalent if the thickness of each spline 244 is substantially equivalent to the thickness of each rib 254) is of such a distance to enable the adjacent splines (or ribs as the case may be) to support the cassette 220 across the spaces 245, 255.

The complementary shaping of the piston 240 and the base 250 enables a resting cassette pumping chamber 230 to be supported by a constant surface area throughout an entire stroke of the piston 240, thereby foreclosing the opportunity for the cassette material to be stretched, unsupported or pinched during movement of the piston 240. Furthermore, the geometric relation between the elements permits a mathematical relation to be established. In the preferred embodiment, for example, the diameter of the piston 240 linearly decreases, relative to the interior of the pumping chamber 230, with the retraction of piston 240. A similar relation exists for the advancement of piston 240. Thus, during retraction of the piston 240, an enclosed volume is created which increases as a quadratic function of the piston's 240 movement. The relation can be used to maintain a constant fluid flow rate because the rate of piston movement can be controlled to achieve a predetermined flow rate.

Although the preferred embodiment defines a base 250 having a receiving surface 258 with a 45-degree angular displacement along the plurality of ribs 254, the angular displacement may measure from 30 to 60 degrees. Notwithstanding, the preferred embodiment ensures (i) a relatively significant pumping chamber volume, (ii) full support of the cassette pumping chamber 230 through an entire pumping stroke, and (iii) avoidance of trapped air within the pumping chamber 230.

Figure 9:
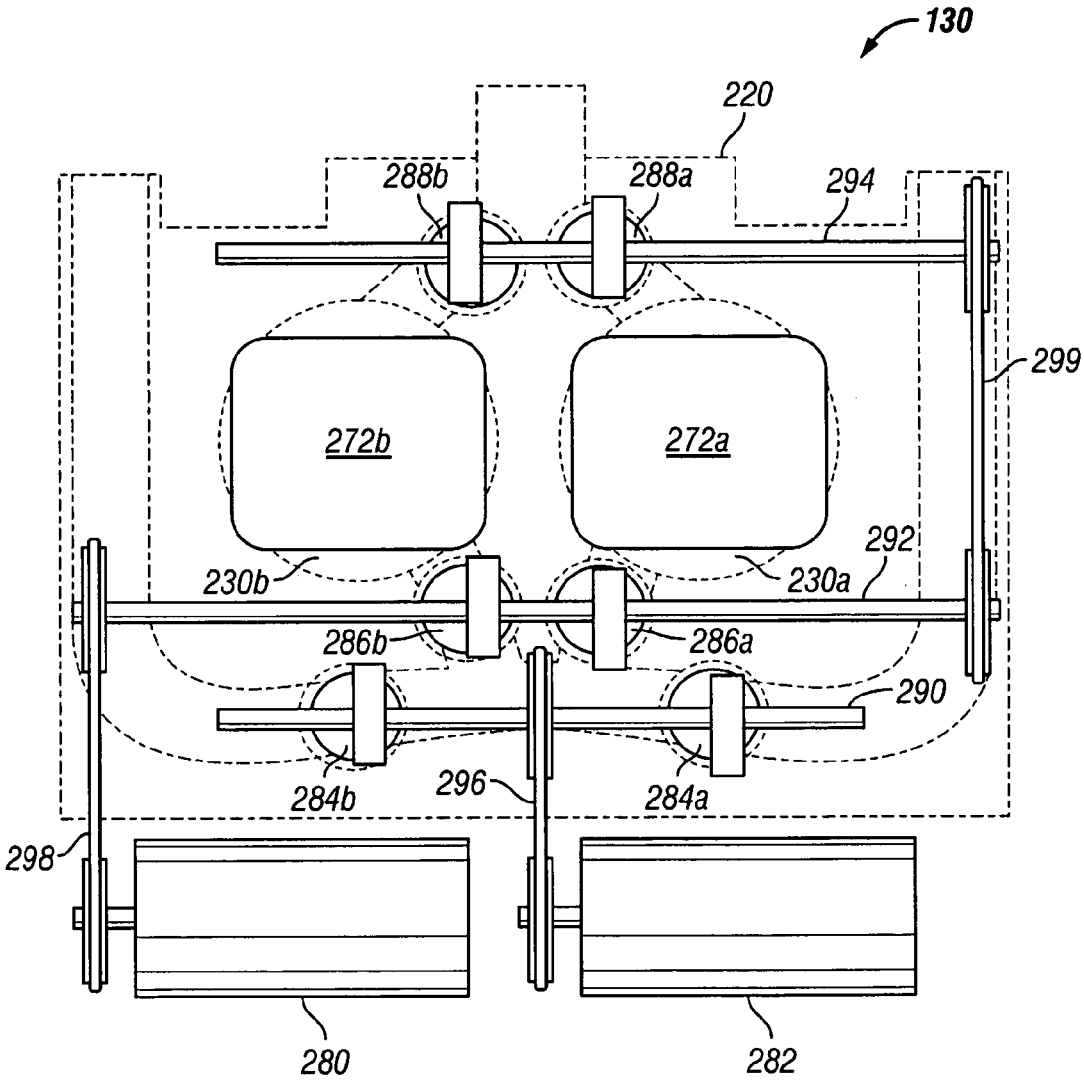
FIG. 9 is a view from beneath a pump mechanism which accommodates the disposable fluid cassette of FIG. 3.
Figure 10:
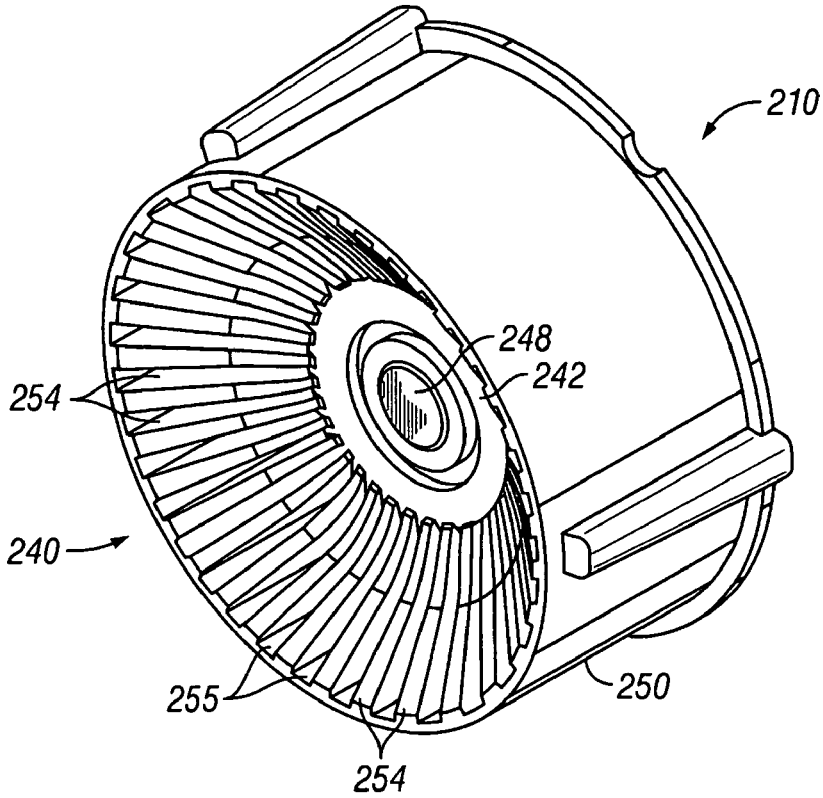
FIG. 10 is a perspective view of the piston assembly of FIG. 4 in a fully retracted state.

FIG. 9 is a rear view of the elements of the pumping mechanism 130 which accommodates the cassette 220 of FIG. 3 (an outline of the cassette 220 is provided). The pumping mechanism 130 incorporates a pair of stepper motors, or pumping motors 272*a*, 272*b*. The pumping motors 272*a*, 272*b* rotationally engage, through attached lead screws 243*a*, 243*b*, a threaded portion 241*a*, 241*b* of each piston 240*a*, 240*b* (see FIG. 2). Two drive motors 280, 282 control the operation of the mechanism's valves. Drive motor 280 engages cam shaft 292 (such driving inlet valves 286*a* and 286*b*) through a timing belt 298. Drive motor 280 also engages cam shaft 294 (such driving outlet valves 288*a* and 288*b*) through a timing belt 299 which rotationally couples cam shafts 292 and 294. Drive motor 282 engages cam shaft 290 (which drives inlet valves 284*a* and 284*b*) through an independent timing belt 296.

Referring to both FIGS. 3 and 9, the interrelation of the pumping mechanism 130 and the fluid mixing operation are better illustrated. In short, mixing of a first and a second fluid, for the purposes of the illustrated embodiment, is accomplished through the continuous introduction of a first and a second fluid into multiple pumping chambers in a predefined, systematic pattern. The pumping mechanism 130, through the operation of a series of valves, controls the flow of fluid throughout the cassette 220. Specifically, a valve, if actuated, presses the first and second sheets of the cassette 220 together at a cassette valve location to occlude the valve location's corresponding flow path.

For pumping mechanism 130, inlet valves 284*a*, 284*b*, 286*a*, 286*b* control the introduction of fluid into the pumping chambers 230*a*, 230*b*. The inlet valves 284*a*, 284*b*, 286*a*, 286*b* act on the cassette 220 at valve locations 234*a*, 234*b*, 236*a* and 236*b*, respectively. Outlet valves 288*a*, 288*b* control the flow of fluid from the pumping chambers 230*a*, 230*b* by acting on cassette valve locations 238*a*, 238*b*. As an example, in preparation of filling pumping chamber 230*b*, valve 286*a* (valve location 236*a*) is actuated to close inlet flow path 228*a*, while valve 288*b* (valve location 238*b*) also occludes outlet path 232*b* to permit the accumulation of fluid within the pumping chamber 230*b*. During filling, valves 284*a*, 284*b* and 286*b* (valve locations 234*a*, 234*b* and 236*b*, respectively) open and close in a predetermined synchronized pattern to permit a ratio of the first and second fluids to enter the pumping chamber 230*b*. Upon completion of the fill, valves 286*b* and 288*a* respectively occlude flow paths 228*b* and 232*a*, and valve 288*b* is de-actuated to permit fluid to flow from the pumping chamber 230*b*. Fluid movement, whether filling or being expelled from the pumping chambers 230*a*, 230*b*, is initiated through the movement of the mechanism's pump assemblies 210*a*, 210*b*.

Referring to FIG. 2 and the operation of the pump mechanism 130, a fastened retaining door 274 tightly constrains the cassette 220 against the upper surface of the pump mechanism. The retaining door 274 possesses a number of cavities 276*a*, 276*b*, such number corresponding to the number of pump assemblies included within the pump mechanism 130. The cavities 276*a*, 276*b* are complementary of and can fully receive at least a portion of the pistons 240*a*, 240*b* when such are in a fully advanced position. Accordingly, the conformance of the cavities 276*a*, 276*b* to the shaping of the pistons 240*a*, 240*b* enables the expulsion of substantially all the fluid from the pump chambers 230*a*, 230*b* for a full piston stroke. Complete fluid displacement makes such pumping mechanism 130 and its methodology suitable for single pumping stroke applications.

When the cassette 220 is operatively positioned in the pump mechanism 130, the cassette pumping chambers 230*a*, 230*b* align with and rest upon the pump assemblies 210*a*, 210*b*. The retaining door 274 effectively constrains the cassette 220 during operation. The formed volume of the paths and chambers of the cassette 220 may be slightly greater or less than the nominal constraining volume defined by the rigid constituents of the pump mechanism 130. Practically, the firm restraints of the pump mechanism 130 permit the development of relatively high fluid pressures within the cassette 220 without significant or detrimental deformation of the cassette material. Indeed, constraining the cassette 220 over effectively the entire cassette surface creates an inherently non-compliant system. Such non-compliance contributes to the ability of the pump mechanism 130 to produce consistent, accurate volumetric fluid delivery.

In the preferred embodiment, the cassette pumping chambers 230*a*, 230*b* do not rest directly upon the supporting surfaces of the piston 240 and/or base 250. Instead, a resilient material 278, attached about the upper portion of the base 250, operates to conform to the supporting surface of the piston assembly 210 without regard to whether the piston 240 is fully advanced, retracted or in some intermediate position. The resilient material 278 protects the pump mechanism 130 from fluid intrusion in the event any liquid is spilled on the device operational environment. The resilient material 278 also acts to further protect the cassette 220 from damage that could inadvertently occur through the operation and movement of the piston assembly 210.

In an alternative embodiment, the resilient material 278 could include reinforcement means to provide additional rigidity to the resilient material 278. As an example, reinforcement means could include a fine metal mesh or cloth embedded within the material used to fabricate the resilient material 278. Alternatively, the resilient material 278 could include a spiral wire which is capable of concentric expansion to provide facial and lateral support for a resting cassette 220 about the interior of the base 250 (when piston 240 is in a retracted position) or about the piston 240 (when piston 240 is in an advanced position). Lastly, the material 278 could be formed of cloth altogether to eliminate any elasticity. This alternative embodiment, and its variations, could permit the use of fewer rib/splines or provide greater reliability in applications that require the piston assembly 130 to operate in larger applications, in the presence of greater fluid pressures or both.

Figure 11:
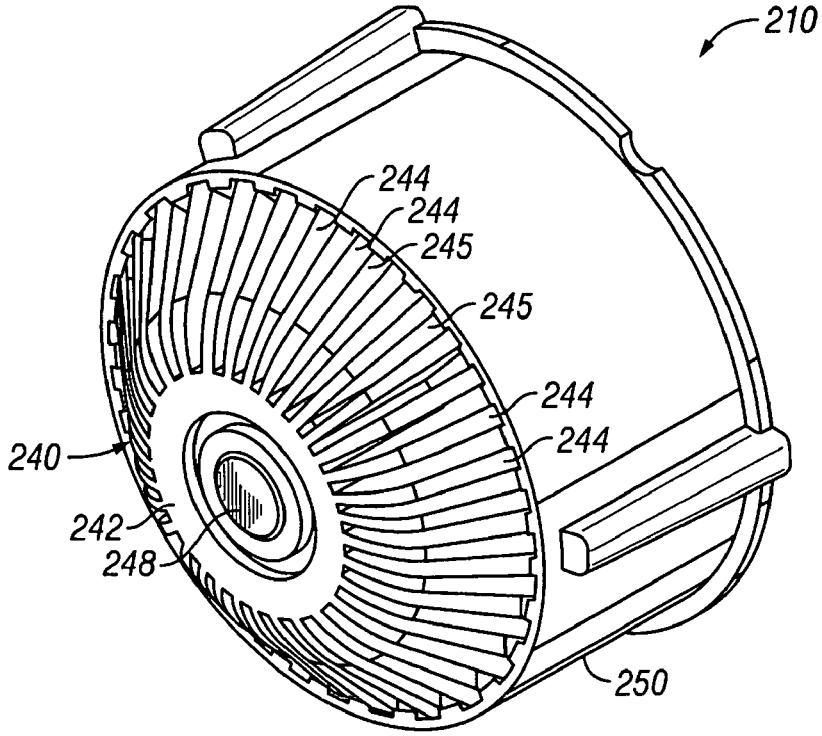
FIG. 11 is a perspective view of the piston assembly of FIG. 4 in a fully advanced state.

Returning to FIG. 2, piston 240*a* is fully retracted (see also FIG. 10) and piston 240*b* is fully advanced (see also FIG. 11). Relative to fluid displacement, pump chamber 230*a* would be substantially full of fluid, and pump chamber 230*b* would have just expelled its contents. For the present embodiment, the pump mechanism 130 can deliver substantially continuous fluid flow through the sequential filling and expulsion of fluid from the pumping chambers 230*a*, 230*b*.

In addition to providing substantially continuous flow, the pump mechanism 130 of the present embodiment incorporates a four-step filling protocol, which is in parallel to the expulsion of fluid from the other pump chamber, to ensure the volumetric accuracy of the delivered fluid. First, valve 288*a* is actuated and a first fluid is introduced into the pumping chamber 230*a* through the synchronized operation of the inlet valves. The pump motor 272*a* retracts a predefined amount to admit a volumetric quantity of the first fluid that, relative to the total volume of the pumping chamber 230*a*, satisfies a predefined fluid mixture ratio. Second, the system tests the volumetric accuracy of the first fluid within the pump chamber 230*a*. As a prelude to performing the test, valve 286*a* is actuated to occlude inlet path 228*a*. The pump motor 272*a* is advanced a few steps to increase the pressure within the pumping chamber 230*a* to a predetermined level. Based upon both the relative position of the piston 240*a* and the measured chamber pressure, the fluid delivery system determines whether a sufficient quantity of fluid was delivered to the pumping chamber 230*a*. Third, a second fluid is introduced into the pumping chamber 230*a* through the synchronized operation of the inlet valves. Lastly, the accuracy of the total fluid volume is tested in accordance with the procedure above. Upon determining that the pump chamber has filled properly, the fill protocol is completed.

As should be gained from this operational description, the piston assembly 210 reduces the opportunity for damage to blood or blood-fluid mixtures in the pumping process. Specifically, the pump assembly 210 does not possess those features that (i) facilitate the trapping of blood in or about the pumping chamber 230 or (ii) subject the blood to damaging compressive forces (roller pumps) or shearing forces (centrifugal pumps).

From the relationship correlating piston position to pumping chamber volume, one will appreciate that various fluids may be mixed at definable ratios through simply controlling the number of steps the pumping motors 272*a*, 272*b* move for each fill stage. As well, the total volumetric flow rate delivered by the pump mechanism 130 is dependent upon the user-defined, flow rate.

FIG. 12 illustrates a timing diagram for the operation of the valve cam motors 280 and 282 in conjunction with the pumping motors 272*a* and 272*b*, in accordance with the prior art. In the cycle described, one chamber pumps a mixture of blood and crystalloid in a selected ratio outwardly from outlet 235 of cassette 220 (FIG. 3), while the other pumping chamber is undergoing a sequential fill and test protocol. Filling chamber is filled with blood to the volume to produce the desired ratio followed by pressure testing of the chamber with its inlet and outlet valves closed to verify capture of the desired amount of blood. Following this step, the drive element of the filling pumping chamber is further retracted and crystalloid solution admitted to complete the filling of the chamber. Then the inlet and outlet valves on the filling chamber are closed to pressure test the chamber for a captured full load. Additional pressure tests and monitoring may be conducted during pumping to determine if there is any unsafe occlusion or to control the pressure within an appropriate safe range for a given procedure.

Thus, at the commencement of the FIG. 12 diagram, the pumping chamber bladder 230*a* has been emptied, and the other bladder 230*b* is full of a blood-crystalloid mixture in the desired proportions. The outlet valve 288*a*, from chamber 230*a* is closed. Outlet valve 288*b* is open to pass the combined fluid from chamber 230*b* through the outlet 235 to the heat exchanger 131 (FIG. 1) at the requested volumetric flow rate. Throughout the period of delivery from chamber 230*b*, its inlet valve 286*b* remains closed, and the corresponding piston 240*b* is advanced by motor 272*b* to reduce the volume of bladder 230*b* to expel the blood/crystalloid solution. The speed of motor 272*b* is governed by the requested flow rate. The outlet valve 288*a* from chamber 230*a* remains closed throughout this period of pumping from chamber 230*b*.

The valves 284*a* and 284*b* controlling inlet of blood and crystalloid to common inlet path 226, and the inlet valve for chamber 230*a* (inlet valve 286*a*) are sequentially opened and closed during the filling protocol for bladder 230*a*, which occupies the time period during which bladder 230*b* is delivering fluid to line 128 (FIG. 1). Thus, when one bladder has completed its pumping step, the other has received solution constituents in the desired ratio and is ready to deliver. Substantially continuous flow is thus enabled, as shown at the top of FIG. 12.

In the 4-step filling protocol for chamber 230*a*, illustrated at the outset of the diagram, valves 284*a* and 286*a* are initially open, and valve 284*b* closed. Thus, an open flow path for entry of blood to chamber 230*a* is provided through inlet 222, common inlet path 226, and pump chamber inlet path 228*a*, while crystalloid is occluded at valve 284*b*. Pump motor 272*a* (shown in FIG. 2) is retracted sufficiently to admit sufficient blood to comprise the desired fraction of total chamber volume. Then valves 284*a* and 286*a* are closed, and pump motor 272*a* is advanced a few steps, to confirm by elevating pressure that the requested blood load has been captured between closed valves 286*a* and 288*a*. With confirmed introduction of the correct amount of blood, valves 286*a* and 284*b* are opened while valve 284*a* remains closed to stop further blood entry. Pump motor 272*a* now retracts to admit the correct volume of crystalloid along paths 225, 226 and 228*a*. This is followed by closing valves 286*a* and 284*b*. Motor 272*a* is advanced briefly to confirm by pressure elevation that the full incremental volume has been occupied by crystalloid solution. With this confirmation, the fill protocol is complete, and chamber 230*a* is ready for delivery on the completion of delivery from chamber 230*b*. As chamber 230*a* then delivers, chamber 230*b* undergoes a similar 4-step filling protocol.

The total volumetric flow rate from the cassette is varied pursuant to operator request simply by compressing or expanding the time for a cycle to be completed. Of course, if intermittent operation is desired, this may be provided as well. No matter what changes may be made to the blood/crystalloid flow rate, microprocessor 146 preferably automatically controls potassium pump 132 to deliver at a concentration which provides the requested potassium concentration.

Turning now to FIG. 13, a timing diagram illustrating the operation of a preferred embodiment of the present invention in a pulsatile flow mode is depicted. In a preferred embodiment, because spline pistons are utilized, the flow rate of the fluid leaving the pumping chamber is related quadratically to the velocity of the piston. To achieve a pulsatile flow, the velocity of the piston is varied cyclically. Period 302 represents this cyclic flow characteristic. While the slopes of 310*a*, 310*b*, and 310*c* appear substantially equal, it is likely that the actual slope would be steeper for 310*b* and 310*c* due to the non-linear nature of the surface area of the piston being applied to the fluid pouch as the piston is advanced.

Period 302 comprises partial-cycles 308*a*, 308*b*, 308*c* during which the piston is moved at a lower velocity, so as to achieve a lower flow rate. During partial-cycles 310*a*, 310*b*, 310*c* the piston is moved at a higher velocity, thus achieving a higher flow rate. The portion of period 302 during which the higher velocity is applied is referred to as the "duty cycle". This velocity characteristic (which also represents the instantaneous flow rate) is a square- or rectangle-wave. Due to compliance in the tubing connecting the cardioplegia delivery system to the patient, the actual flow rate characteristic and actual fluid pressure characteristic experienced by the patient is more sinusoidal in nature, as shown at the top of FIG. 13. It should also be noted that the flow rate(s) so obtained have the desirable property of being independent of the fluid pressure of the fluid being pumped. A desirable fluid pressure, for physiological purposes, is within the range of 50-250 mmHg.

The upper and lower velocities, corresponding to upper and lower flow rates, respectively, are selected so as to achieve a desired average flow rate over time given a particular amplitude and duty cycle for the pulsatile flow. The difference in pressure obtained during the upper flow rate and that obtained during the lower flow rate is called the "pulse pressure." An operator may also specify a particular frequency, corresponding to a simulated heart rate, at which the operator wishes the pulsatile flow to run. In order to simulate normal physiological conditions, a frequency of between 50-90 beats per minute is typically used. As shown in FIG. 13, the position of the piston varies at a low rate of change 308 during the low-velocity portions of period 302, while the position changes at a higher rate 310 during the high-velocity portions of period 302. Although the instantaneous velocity of the piston, and hence the instantaneous flow rate of the fluid being pumped, changes from instant-to-instant, the average rate of flow over time is a constant and is the same as would be achieved using a non-pulsatile flow.

Given a desired average flow rate, a desired amplitude, and a desired duty cycle, the microprocessor control of a preferred embodiment of the present invention calculates an appropriate upper and lower flow rate. FIG. 14 is a flowchart representation of a process of computing these upper and lower flow rates in a preferred embodiment of the present invention. First, the desired average flow rate (expressed in mL/min.), a desired amplitude (representing the desired magnitude of the upper flow rate as expressed as a percentage of the average flow rate), and a duty cycle (expressed as a percentage of a given cycle to be spent at the upper flow rate) are provided by the user (block 400). In a preferred embodiment, the amplitude may range from 50% to 300%, and the duty cycle may range from 10% to 50%. Next, the appropriate upper flow rate is calculated from the amplitude, as (1+Amplitude)×Avg. flow rate (block 402).

For safety purposes, one embodiment of the present invention supports a maximum upper flow rate of 750 mL/min. Therefore, if the upper flow rate calculated in block 402 exceeds 750 mL/min (block 404:Yes), then the upper flow rate is set to 750 mL/min. Then the amplitude is adjusted to be 750 mL/min./Avg. flow rate (block 406), and the process cycles back to block 408. The lower flow rate is calculated as $$\left(1+\frac{\text{Duty cycle}\times\text{Amplitude}}{\text{Duty cycle}-1}\right)\times Avg.\ \text{flow rate (block 408).}$$

If this lower flow rate is less than 10 mL/min. (block 410: Yes), the lower flow rate is set to 10 ml/min. Then the amplitude is adjusted to be $$\left(\frac{10-Avg.\ \text{flow rate}}{Avg.\ \text{flow rate}}\right)\times\left(\frac{\text{Duty cycle}-1}{\text{Duty cycle}}\right)\text{(block 412),}$$

and the process cycles back to block 414.

If the lower flow rate is greater than the minimum value of 10 mL/min. (block 410:No), then a cyclic flow profile, such as that depicted in FIG. 13 is commenced, in which the velocity of the piston, and hence the instantaneous flow rate of the fluid delivered to the patient, cycles between the calculated upper and lower flow rates, according to the prescribed duty cycle and frequency (block 414).

One of the preferred implementations of the invention is a client application, namely, a set of instructions (program code) or other functional descriptive material in a code module that may, for example, be resident in the random access memory of a microprocessor, microcontroller, or other computer (e.g., microprocessor control section 146 in FIG. 1). Until required by the computer, the set of instructions may be stored in another computer memory, for example, in a hard disk drive, or in a removable memory such as an optical disk (for eventual use in a CD ROM) or floppy disk (for eventual use in a floppy disk drive), or downloaded via the Internet or other computer network. Thus, the present invention may be implemented as a computer program product for use in a computer. In addition, although the various methods described are conveniently implemented in a general purpose computer selectively activated or reconfigured by software, one of ordinary skill in the art would also recognize that such methods may be carried out in hardware, in firmware, or in more specialized apparatus constructed to perform the required method steps. Functional descriptive material is information that imparts functionality to a machine. Functional descriptive material includes, but is not limited to, computer programs, instructions, rules, facts, definitions of computable functions, objects, and data structures.

While particular embodiments of the present invention have been shown and described, it will be obvious to those skilled in the art that, based upon the teachings herein, changes and modifications may be made without departing from this invention and its broader aspects. Therefore, the appended claims are to encompass within their scope all such changes and modifications as are within the true spirit and scope of this invention. Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an;" the same holds true for the use in the claims of definite articles.

What is claimed is:

1. A method of creating a continuous pulsatile flow of fluid into a biological destination, comprising:

providing a piston pump having at least one pump chamber, wherein said pump chamber holds a disposable flexible cassette formed from two sheets of flexible material bonded together along a selected bond area to form at least one fluid-containing chamber and particularized open flow paths;

providing a spline piston adjacent to said pump chamber in the piston pump;

wherein advancement of the piston causes fluid to flow from said flexible cassette in the pump chamber to the biological destination, wherein the flow rate of the fluid leaving the pumping chamber is related quadratically to the velocity of the piston and wherein said flow rate is independent of fluid pressure; and advancing the piston according to a cyclical, time-varying velocity profile that emulates a human heart, wherein advancement of the piston is divided into multiple periods, each period including a first partial cycle at a predefined, controlled lower velocity and a second partial cycle at a predefined, controlled upper velocity, and wherein the predefined upper and lower controlled velocities of the piston correspond to an upper and a lower output flow rate, respectively.

2. The method of claim 1, wherein the velocity of the piston varies according to a rectangle-wave characteristic having a duty cycle.

3. The method of claim 2, further comprising:

receiving user input to specify the duty cycle for the rectangle-wave characteristic.

4. The method of claim 1, further comprising:

selecting the time-varying velocity profile so as to maintain a constant average flow rate.

5. The method of claim 4, wherein selecting the time-varying velocity profile further comprises computing the time-varying velocity profile from a desired amplitude, a desired duty cycle, and a desired average flow rate or pulse pressure.

6. The method of claim 5, wherein the time-varying velocity profile includes an upper flow rate and a lower flow rate, which are computed from the desired amplitude, desired duty cycle, and desired average flow rate or pulse pressure.

7. The method of claim 5, further comprising:

obtaining user input to specify the desired amplitude, desired duty cycle, and desired average flow rate or pulse pressure.

8. The method of claim 1, further comprising:

obtaining user input to specify a frequency for the time-varying velocity profile.

9. The method of claim 1, wherein the fluid pumped from the pump chamber passes through additional at least one additional apparatus before entering the biological destination.

10. The method of claim 9, wherein the at least one additional apparatus includes a compliant fluid delivery line.

11. The method of claim 9, wherein the at least one additional apparatus includes a heat exchanger.

12. The method of claim 1, wherein a flow rate of the fluid pumped from the pump chamber is independent of fluid pressure.

13. The method of claim 12, wherein the organ is a heart.

14. The method of claim 1, wherein the fluid includes at least one of blood, crystalloid solution, cardioplegia solution, and other medication.

15. The method of claim 1, wherein the biological destination is an organ.

16. The method of claim 1, wherein the biological destination is an organism.

17. The method of claim 16, wherein the organism is a human being.

18. The method of claim 1, wherein the piston contains a pressure sensor to determine pressure within the pump chamber.

19. The method of claim 1, further comprising:

selecting the time-varying velocity profile so as to maintain a constant pulse pressure over time.

20. A continuous pulsatile fluid delivery system comprising:

a piston pump having at least one pump chamber, wherein said pump chamber holds a disposable flexible cassette formed from two sheets of flexible material bonded together along a selected bond area to form at least one fluid-containing chamber and particularized open flow paths;

a spline piston adjacent to said pump chamber in the piston pump;

wherein advancement of the piston causes fluid to flow from said flexible cassette in the pump chamber to the biological destination, wherein the flow rate of the fluid leaving the pumping chamber is related quadratically to the velocity of the piston and wherein said flow rate is independent of fluid pressure;

a control system configured to control operation of the piston pump; and an instruction set implemented in said control system, wherein the instruction set advances the piston according to a cyclical, time-varying velocity profile that emulates a human heart, wherein advancement of the piston is divided into multiple periods, each period including a first partial cycle at a predefined, controlled lower velocity and a second partial cycle at a predefined, controlled upper velocity, and wherein the predefined upper and lower velocities of the piston correspond to an upper and a lower output flow rate, respectively.

21. The fluid delivery system of claim 20, wherein the velocity of the piston varies according to a rectangle-wave characteristic having a duty cycle.

22. The fluid delivery system of claim 21, further comprising:

a user input device, wherein the user input device receives user input to specify the duty cycle for the rectangle-wave characteristic.

23. The fluid delivery system of claim 20, wherein the control system selects the time-varying velocity profile so as to maintain a constant average flow rate.

24. The fluid delivery system of claim 23, wherein selecting the time-varying velocity profile further comprises computing the time-varying velocity profile from a desired amplitude, a desired duty cycle, and a desired average flow rate or pulse pressure.

25. The fluid delivery system of claim 24, wherein the time-varying velocity profile includes an upper flow rate and a lower flow rate, which are computed from the desired amplitude, desired duty cycle, and desired average flow rate or pulse pressure.

26. The fluid delivery system of claim 24, further comprising:

a user input device, wherein the user input device obtains user input to specify the desired amplitude, desired duty cycle, and desired average flow rate or pulse pressure.

27. The fluid delivery system of claim 20, further comprising:

a user input device, wherein the user input device obtains user input to specify a frequency for the time-varying velocity profile.

28. The fluid delivery system of claim 20, wherein the fluid pumped from the pump chamber passes through additional at least one additional apparatus before entering the biological destination.

29. The fluid delivery system of claim 28, wherein the at least one additional apparatus includes a compliant fluid delivery line.

30. The fluid delivery system of claim 28, wherein the at least one additional apparatus includes a heat exchanger.

31. The fluid delivery system of claim 20, wherein a flow rate of the fluid pumped from the pump chamber is independent of fluid pressure.

32. The fluid delivery system of claim 20, wherein the fluid includes at least one of blood, crystalloid solution, cardioplegia solution, and other medication.

33. The fluid delivery system of claim 20, wherein the biological destination is an organ.

34. The fluid delivery system of claim 33, wherein the organ is a heart.

35. The fluid delivery system of claim 20, wherein the biological destination is an organism.

36. The fluid delivery system of claim 35, wherein the organism is a human being.

37. The fluid delivery system of claim 20, wherein the piston contains a pressure sensor to determine pressure within the pump chamber.

38. The fluid delivery system of claim 20, wherein the control system selects the time-varying velocity profile so as to maintain a constant pulse pressure over time.

* * * * *